US006119761A

United States Patent [19]

Anazawa et al.

[11] Patent Number: 6,119,761

[45] Date of Patent: Sep. 19, 2000

[54] METHOD FOR MAKING A HOLLOW CAST ARTICLE BY THE LOST WAX METHOD

[75] Inventors: Takuma Anazawa; Hisayoshi Harada, both of Wako, Japan

[73] Assignee: Honda Giken Kogyo Kabushiki Kaisha, Tokyo, Japan

[21] Appl. No.: 08/906,625

[22] Filed: Aug. 7, 1997

[30] Foreign Application Priority Data

Aug. 9, 1996 [JP] Japan ..... 8-210731

[51] Int. Cl.[7] ..... B22C 9/02; B22C 9/10; B22D 33/04

[52] U.S. Cl. ..... 164/35; 164/30; 164/519; 164/137

[58] Field of Search ..... 164/35, 30, 132, 164/519, 137

[56] References Cited

U.S. PATENT DOCUMENTS

| | | | |
|---|---|---|---|
| 3,596,703 | 8/1971 | Bishop | 164/132 |
| 4,216,815 | 8/1980 | Feagin | 164/519 |
| 4,811,778 | 3/1989 | Allen et al. | 164/516 |
| 4,986,333 | 1/1991 | Gartland | 164/30 |

*Primary Examiner*—Patrick Ryan
*Assistant Examiner*—I.-H. Lin
*Attorney, Agent, or Firm*—Lyon & Lyon LLP

[57] ABSTRACT

A method to suppress displacement of the core during casting when making hollow blades by applying the lost wax method using a core. A wax pattern is made which comprises a core and a layer of wax covering the core. Then at least one pin of the same material as the blade is inserted into the wax layer such that this pin engages the core and part of the pin projects from the outer surface of the wax layer, after which, with the portion of the pin which projects from the outer surface of the wax layer being held in a casting mold, the wax is removed, followed by casting.

8 Claims, 3 Drawing Sheets

METHOD FOR MAKING A HOLLOW CAST ARTICLE BY THE LOST WAX METHOD

The present invention relates to a method for making a hollow cast article by the lost wax method and, in particular, metal castings such as gas turbine blades.

The blades in the nozzle vanes of gas turbines are a prior known example of this type of a hollow cast article. In these blades there is a portion of the blade on the suction side and a portion of the blade on the pressure side, with the thicknesses of the blades being as thin as about 1 mm. In addition, the trailing edge portion of the portion of the blade on the suction side projects beyond the leading edge portion of the portion of the blade on the pressure side.

When casting such gas turbine blades, the thicker portion of the core for the blade is held in the mold via core prints and the end of the thin portion of the core which forms the trailing edge and leading edge portions is held in the mold by forming the core in such a way that it projects beyond the trailing edge portion.

However, when a casting method such as that described previously is adopted the molten metal fills the region of the cavity which forms the leading edge before the region which forms the trailing edge, due to the fact that the leading edge is shorter than the trailing edge, and consequently there is the problem that the molten metal displaces the thin portion of the core towards the region which forms the trailing edge and, as a result, the thickness of the trailing edge portion becomes extremely thin while the thickness of the leading edge portion becomes extremely thick, burrs are generated in the leading edge portion, and when the aforementioned displacement is large, poor flow of the molten metal occurs in the trailing edge.

An object of the present invention is to provide a method for making a hollow cast article by the aforementioned lost wax method which can prevent undesirable variations in the thickness of the hollow cast article, the generation of burrs, and the poor flow of the molten metal by adopting comparatively simple means.

According to the present invention, which achieves the aforementioned object, a method for making a hollow cast article by the lost wax method is provided in which, in making a hollow cast article applying the lost wax method using a core, a wax pattern is prepared which comprises a wax layer covering the aforementioned core, and then at least one pin of the same material as the aforementioned hollow casting is inserted into the aforementioned wax layer such that this pin comes up against the aforementioned core and part of the aforementioned pin projects from the outer surface of the aforementioned wax layer, after which, with the portion of the aforementioned pin which projects from the outer surface of the wax layer being held in a casting mold, the wax is removed, followed by casting.

By adopting the aforementioned means it is possible to suppress the displacement of the core during casting by means of the pins.

In this way it is possible to prevent undesirable variations in the thickness of a hollow cast article and the generation of burrs, and to avoid a poor flow of molten metal, by a comparatively simple method employing the advantages of the lost wax method together with a pin.

In addition, because the material of the pin is the same as the material of the hollow cast article, compatibility with the molten metal is good and the strength of the blade, etc., is not adversely affected if the pin melts after fulfilling its function.

DESCRIPTION OF THE PREFERRED EMBODIMENT

Figure 1:
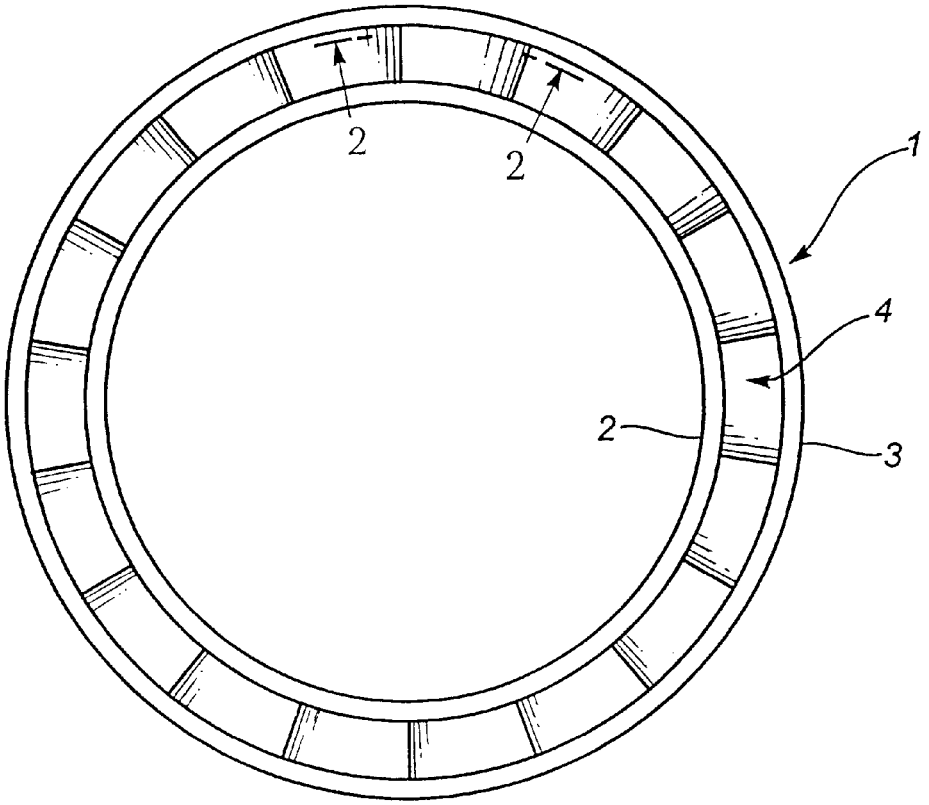
FIG. 1 is a plan view of a gas turbine nozzle vane assembly.
Figure 2:
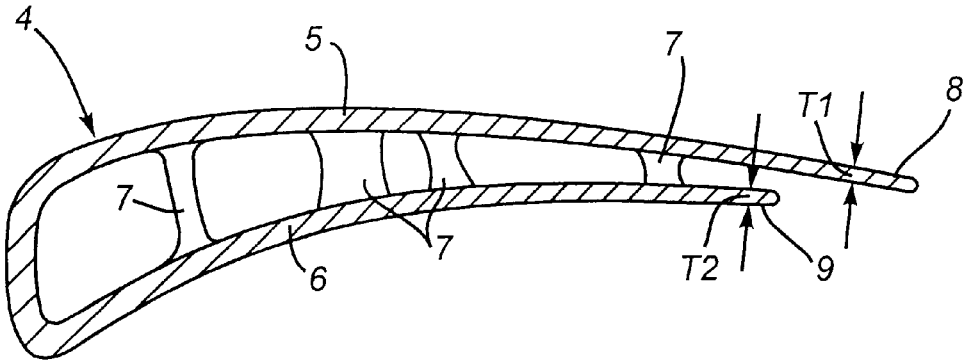
FIG. 2 is an enlarged sectional view of one blade of the vane assembly taken along line 2—2 of FIG. 1.

The nozzle vane assembly 1 of a gas turbine shown in FIGS. 1 and 2 is formed of a cobalt-based heat-resistant alloy, and comprises an annular inner shroud 2, an annular outer shroud 3 around the outside thereof, and a plurality of blades 4 which are the "hollow cast articles" of this illustrative embodiment between the inner and outer shrouds 2 and 3, with these three members 2, 3 and 4 being cast in one piece.

Each blade 4 has a side portion 5 of the blade on the suction side, a side portion 6 of the blade on the pressure side and a plurality of connecting pieces 7 connecting these side portions 5 and 6, with the thickness of these blade side portions 5 and 6 being very thin, such as about 1 mm. In addition, the trailing edge portion 8 of the blade on the suction side portion 5 projects beyond the leading edge portion 9 of the blade on the pressure side portion 6.

Figure 6:
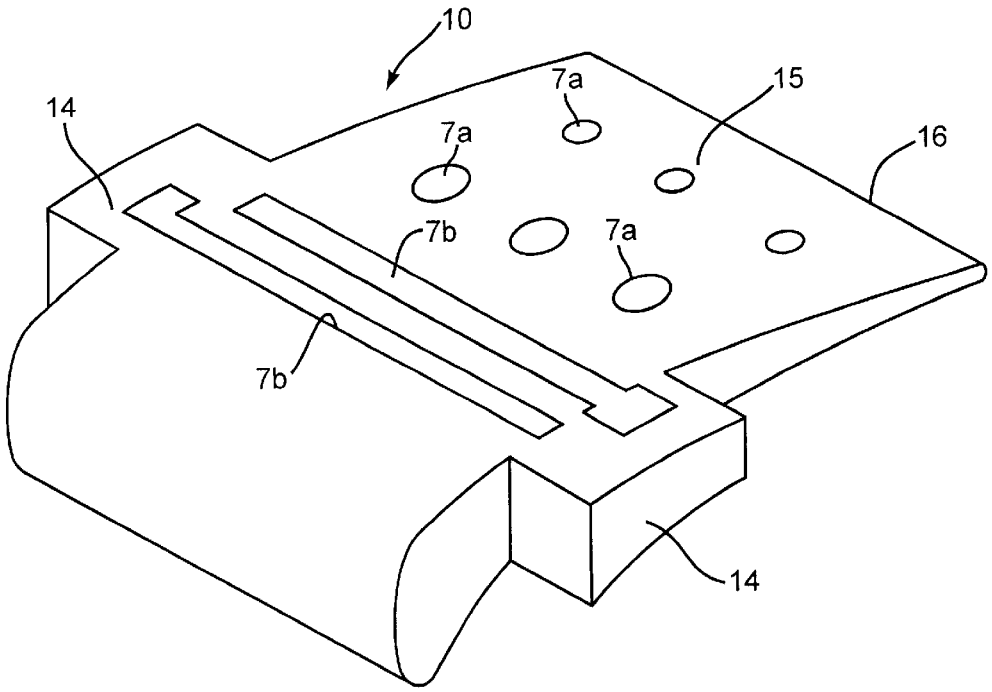
FIG. 6 is a perspective view of a core for forming the blade.

Referring to FIG. 6, a core 10 is shown for forming the blade by the lost wax method. The core 10 is provided with outwardly extending core prints 14 for supporting the core, as described below, a plurality of holes 7*a* for forming some of the connecting pieces 7, a pair of slots 7*b* for forming the remaining connecting pieces 7.

A lost wax method of casting was adopted for making the nozzle vane assembly 1, by this invention and, specifically, the following process steps were used.

(a) The core 10 for the blade 4 was placed in a wax mold. This core 10 was made of silica.

(b) Wax was injected into the wax mold to make a wax pattern 12 for the blade, which comprised the core 10 and a wax layer 11 covering the core 10. The pair of core prints 14 present in the thick body portion 13 of the core 10 project from the wax layer 11, and the end 16 of the thin portion 15 of the core 10 forming the trailing edge portion 8 and the leading edge portion 9 projects beyond the portion 17 of the wax layer 11 which corresponds to the trailing edge 8.

(c) The wax pattern 12 for the blade was subjected to a finishing process.

Figure 3:
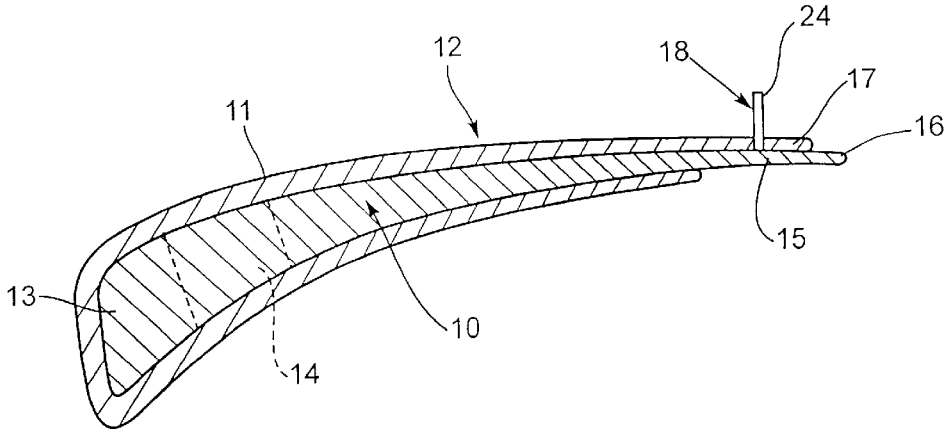
FIG. 3 is a sectional view of a wax pattern for the blade shown in FIG. 2.
Figure 4:
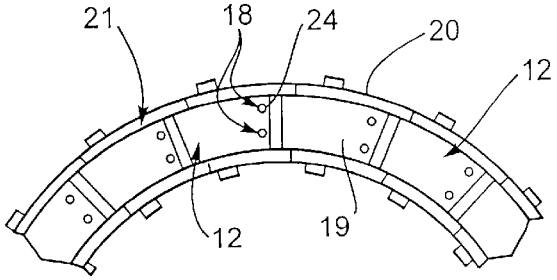
FIG. 4 is a plan view of a portion of a wax pattern for the nozzle vane assembly.

(d) A plurality of pins 18 of about 4–5 mm long were cut from 1.6-mm diameter wire made from FSX-414 cobalt-based heat-resistant alloy, and these pins 18 were given a flat finish on one end. As shown in FIGS. 3 and 4, at least one pin 18, and in the preferred embodiment two pins, were inserted into the portion 17 of the wax layer 11 corresponding to the trailing edge 8, with the flat surface thereof against the surface of the thin portion 15 of the core 10, and part of the pin 18 projecting outside the portion 17 corresponding to the trailing edge.

Figure 7:
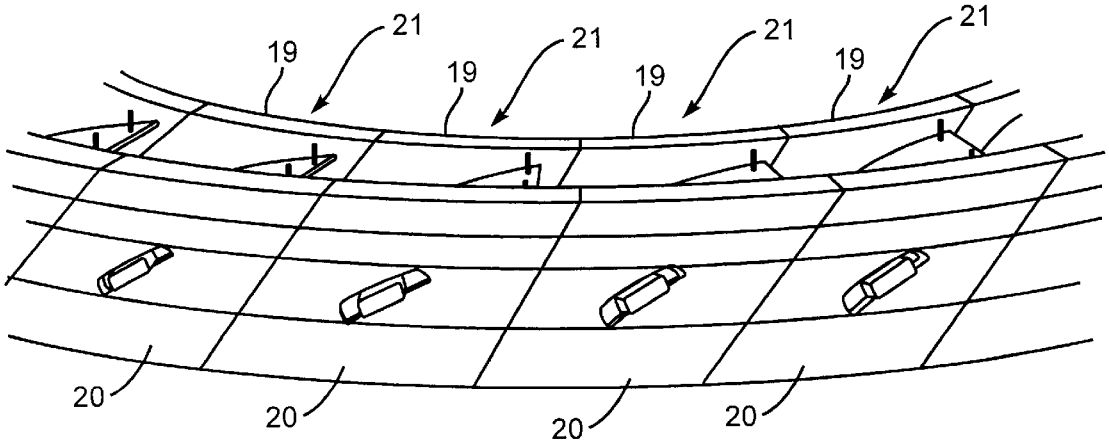
FIG. 7 is a perspective view of a portion of the assembled wax patterns for forming a gas turbine nozzle vane assembly.

(e) A plurality of wax patterns 12 for blades were made by the aforementioned method, and a like plurality of wax patterns 19 and 20 of short arcuate segments for the inner and outer shrouds were also made as shown in FIGS. 4 and 7.

(f) Wax patterns 21 for the nozzle vane assembly of FIG. 4 were assembled using the plurality of wax patterns 12 for the blades and the wax patterns 19 and 20 for the inner and outer shrouds, and a plurality of these wax patterns 21 for nozzle vanes were prepared.

(g) A circular tree was assembled using the plurality of wax patterns 21 for nozzle vanes with the core prints being used to support the wax patterns in the assembled array.

(h) The tree was immersed in slurry and then given a stucco coating, after which the coating layer was dried; this cycle was repeated 8 times to make a shell mold for casting.

Figure 5:
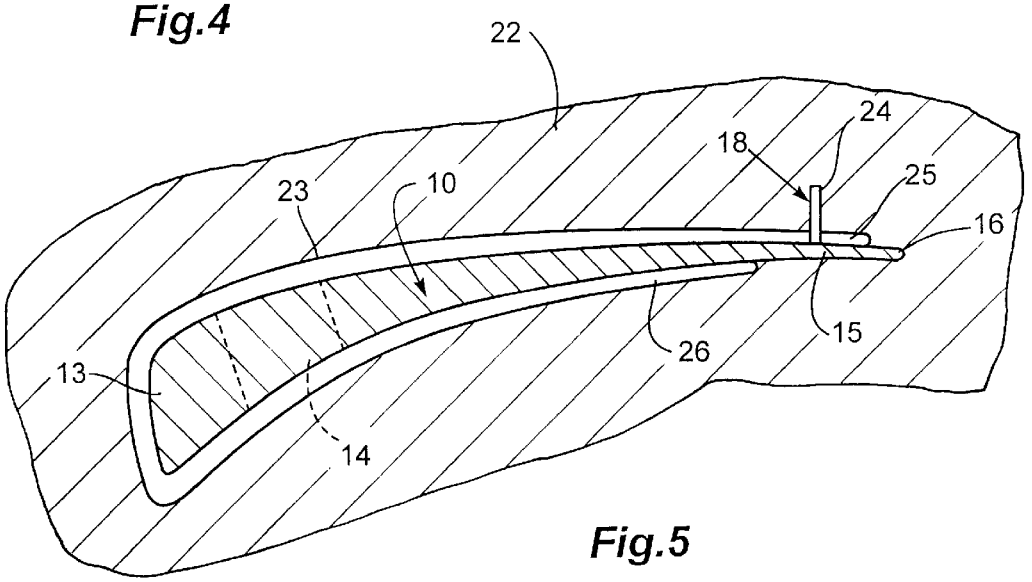
FIG. 5 is a sectional view showing the cavity for forming a blade in a shell mold.

(i) The wax was removed from the shell mold by heating in an autoclave, and then the shell mold was baked at 700° C. for 3 hours. As shown in FIG. 5, the body 13 of each core 10 was held in the shell mold 22 via the two core prints 14 and 14, and the end 16 of the thin portion 15 was held embedded in the shell mold 22. A cavity 23 for forming the blade was formed around this core 10, and the portions 24 of the two pins 18 in each core 10 which projected outside the wax layer 11 were held embedded in the shell mold.

(j) FSX-414 cobalt-based heat-resistant alloy was melted using a vacuum founding furnace, and casting was performed by gravity casting using the molten metal, at a casting temperature of 1499° C., with a shell mold temperature of 1160° C. and a holding time of 0.5 hours.

(k) The shell mold 22 was broken open, and the runners and gates, etc., were cut away to obtain a number of nozzle vanes assemblies 1, after which each of the nozzle vane assemblies 1 was shaken out.

(l) Each nozzle vane assembly 1 was immersed in 20% caustic soda solution to dissolve away the core 10.

(m) The nozzle vane assemblies 1 were subjected to a finishing process. On visual examination of the state of the surface of each of the blades 4 in each of the resulting nozzle vane assemblies 1, as shown in FIG. 2, no metal flow faults had occurred in the trailing edge portion 8 of the blade 5 on the suction side, and no burring was produced on the leading edge portion 9 of the blade 6 on the pressure side.

Moreover, it was evident that the thicknesses $T_1$ and $T_2$ of both edges 8 and 9 were almost the same, with thickness $T_1$ of the trailing edge portion 8 of $T_1 \approx 0.9$ mm, and thickness $T_2$ of the leading edge portion 9 of $T_2 \approx 0.95$ mm.

The reason why such results are obtainable is believed to be as follows. During casting the molten metal fills the region 26 of the cavity 23 which forms the leading edge before it fills the portion 25 which forms the trailing edge, due to the fact that the leading edge portion 9 is shorter than the trailing edge portion 8, and displacement of the thin portion 15 of the core 10 toward the region 25 forming the trailing edge, by the molten metal, is suppressed by the two pins 18.

When a number of nozzle vane assemblies 1 were made by the same method as described previously using pins 18 of a diameter of 0.7 mm, rather than the 1.6 mm diameter, made of the same material as described previously, the results obtained were similar to those obtained previously.

It should be noted that the present invention can also be applied to the manufacture of hollow castings other than the aforementioned blades 4. By means of the present invention it is possible to obtain high quality hollow casting articles by adopting the comparatively simple means described previously.

What is claimed:

1. A method for making a hollow cast gas turbine blade by a lost wax method, wherein the gas turbine blade has a leading edge and a trailing edge along one end of the blade with a thin opening between the leading edge and the trailing edge and with the trailing edge extending beyond the leading edge, the method comprising the steps of preparing a wax pattern comprised of a core and a wax layer covering the core with the wax layer being in the shape of the gas turbine blade and the core having an extension portion extending between leading edge and trailing edge portions of the wax layer to form the thin opening and with the extension portion extending beyond the trailing edge to a support end, inserting at least one pin of the same material as the hollow cast article into the wax layer at a location between an end of the leading edge portion and an end of the trailing edge portion to engage the core with a part of the pin projecting from the outer surface of the wax layer, preparing a shell mold with the part of the pin which projects from the outer surface of the wax layer being held in the shell mold for supporting the extension portion of the core and with the core support end being fixed in the shell mold, removing the wax by heating the shell mold, and filling the shell mold with a molten metal to form the hollow cast article.

2. A method according to claim 1 wherein the material of the hollow cast gas turbine blade and the pin is a cobalt-based, heat-resistant alloy.

3. The method according to claim 1 wherein said core is formed with apertures therethrough and said wax layer includes wax filling the apertures to form connecting pieces between opposite sides of the hollow cast gas turbine blade.

4. The method according to claim 1, wherein said core is formed with laterally extending core prints for supporting said core in the shell mold.

5. The method according to claim 1 including a step, before the step of preparing the shell mold, of assembling a plurality of said wax patterns into an arcuate series and then preparing a composite shell mold with said plurality of wax patterns.

6. The method according to claim 5, wherein the arcuate series comprises a complete 360° ring of said wax patterns.

7. The method according to claim 5 including the steps for preparing a plurality of arcuate segment wax patterns comprising inner and outer shrouds, and assembling said shroud wax patterns with said turbine blade wax patterns into said arcuate series and preparing said shell mold with the assembled shroud wax patterns and turbine blade wax patterns.

8. The method according to claim 7, wherein the arcuate series comprises a complete 360° ring of said wax patterns.

* * * * *